United States Patent [19]

Wilson

[11] 4,034,678

[45] July 12, 1977

[54] TOY CAR AND TRACK SYSTEM

[76] Inventor: Warren Elvin Wilson, P.O. Box 4236, Incline Village, Nev. 89450

[21] Appl. No.: 673,279

[22] Filed: Apr. 2, 1976

[51] Int. Cl.[2] ..... B61B 15/00

[52] U.S. Cl. ..... 104/87; 46/216; 104/118; 104/125; 104/126; 104/130; 104/147 A; 238/10 R

[58] Field of Search ..... 104/53, 56, 57, 87, 104/118, 125, 126, 130, 131, 147 A, DIG. 1; 105/1 T, 141; 238/10 R, 10 A, 10 E, 10 F; 46/1 K, 216; 246/415 A, 418

[56] References Cited

U.S. PATENT DOCUMENTS

| | | | |
|---|---|---|---|
| 2,193,687 | 3/1940 | Flinn | 104/87 X |
| 3,093,090 | 6/1963 | Rosenbaum | 104/118 X |
| 3,533,356 | 10/1970 | Toutoundjis | 104/130 X |
| 3,603,505 | 9/1971 | Tsugawa | 238/10 A X |

*Primary Examiner*—Robert J. Spar
*Assistant Examiner*—Randolph A. Reese

[57] ABSTRACT

A toy train system providing a plurality of sections of rigid and flexible track members and a switching device for selectively connecting one of the members together. The switching device includes a pair of stationary rings and a rotatable ring with the flexible pieces of track extending between them and selectively registerable with the rigid track members at one of them. Self powered cars are equipped to travel the tracks in upside down condition, upright or on their side, the tracks being especially formed to receive the cars and maintain their security regardless of their oriented condition.

1 Claim, 7 Drawing Figures

TOY CAR AND TRACK SYSTEM

The invention relates to toy trains and the like and, in particular, a plurality train system employing monorail type tracks suspended in the air with electrified cars and the like adapted to traverse them at controlled velocities.

According to the invention there is provided a monorail type system employing a pluraity of cars and tracks. In addition, there is provided a switching system which interconnects the tracks in at least three different modes of operation from on the one hand having each car run on its own separate track to, on the other hand, interconnecting all the tracks together whereby the cars run on the same but lengthened track. This capability of the simulated train system is achieved by the provision of a special switching device employing track pieces fabricated of a flexibile material which provide the selective interconnection with plastic or rigid track sections, the two kinds of track being identically shaped. If desired, a portion of the track can be electrified with a rheostat provided for speed control to permit the cars to be run competitively to reach a predetermined position within a specified time interval. However this system is used the mechanical arrangement and composition of the individual components in the purview of the invention are basically the same.

One object of the invention is to provide a monorail type, toy train system employing multiple tracks and a rotatable switch device with track interconnecting links for placing the system in selected modes of operation.

Other objects and advantages of the invention may be appreciated on reading the following description of one embodiment thereof which is taken in conjunction with the accompanying drawings, in which.

Figure 1:
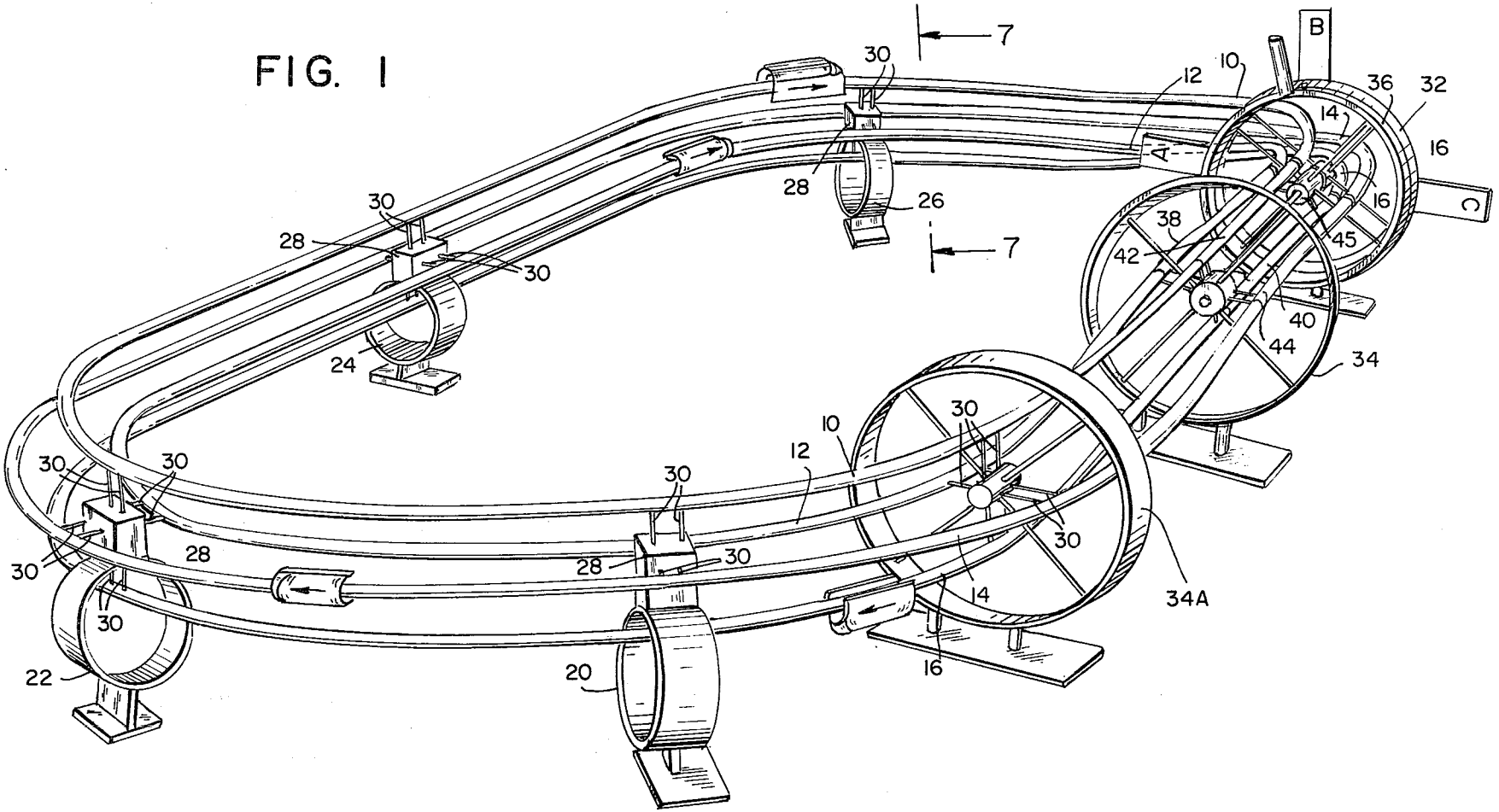
FIG. 1 is a perspective view of the toy train system.

Referring to the drawings, the toy train system provides a top oval plastic track section 10, a left and right oval track section 12 and 14 respectively, and bottom oval track section 16. The relative positions of the tracks are maintained by ring supports 18, 20, 22, 24 and 26. Atop each ring is a strut support 28 and a pair of struts 30 leading to each track.

Figure 2:
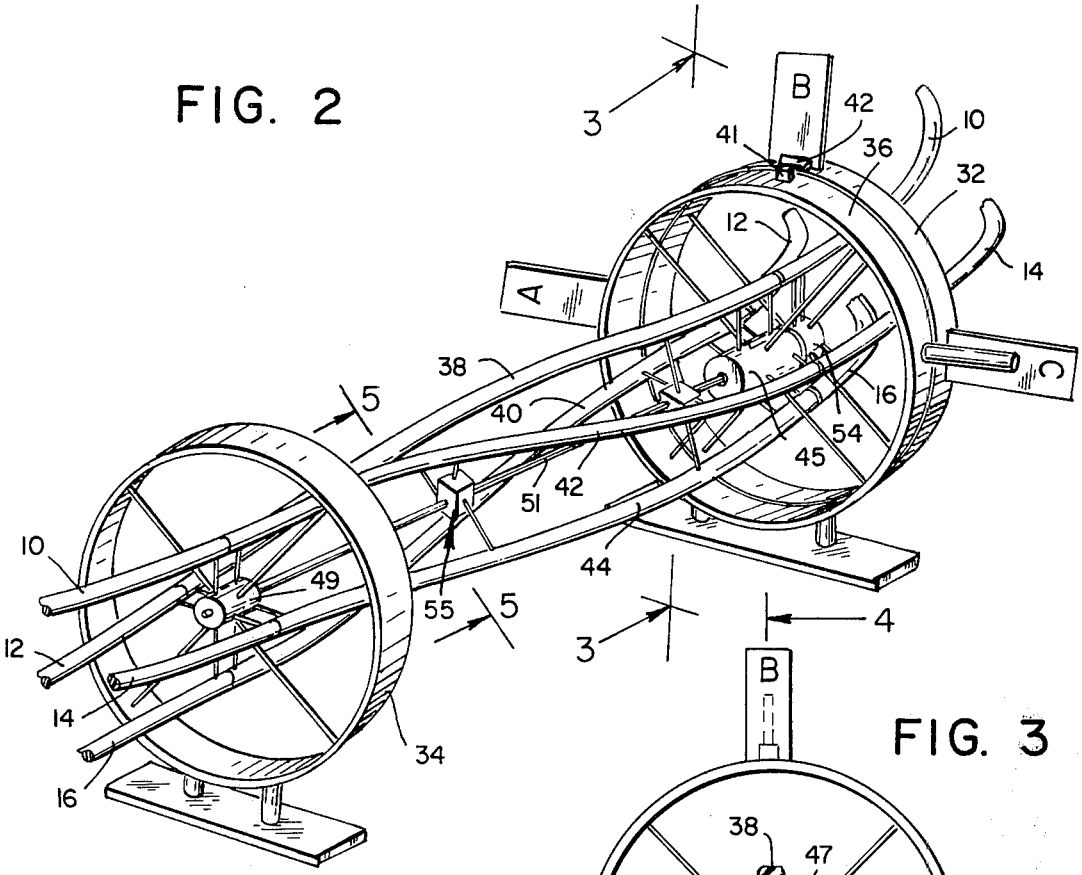
FIG. 2 is an enlarged view of the switch device for the system.
Figure 3:
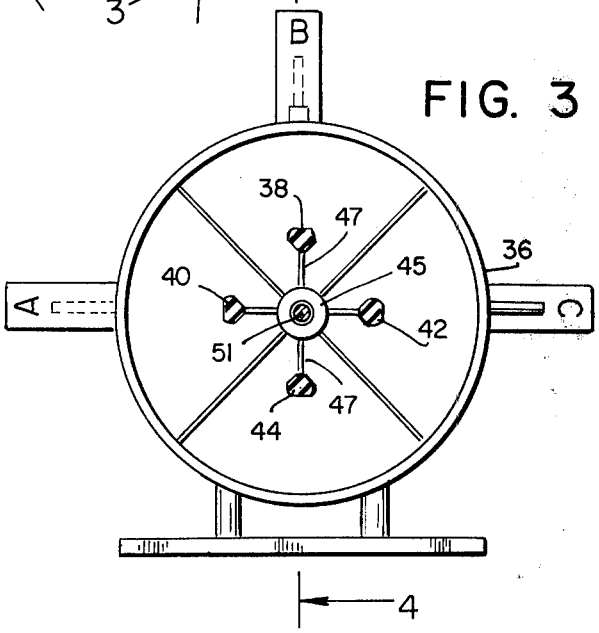
FIG. 3 is a section taken on the line 3—3 of FIG. 2.
Figure 4:
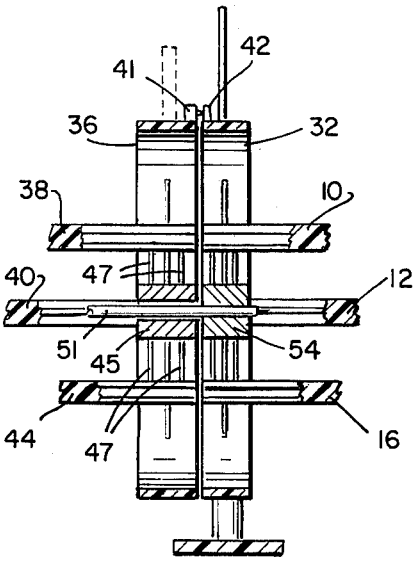
FIG. 4 is a section taken on the line 4—4 of FIG. 3.
Figure 5:
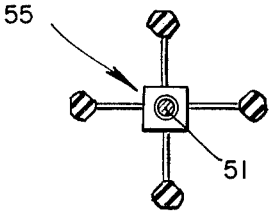
FIG. 5 is a section taken on the line 5—5 of FIG. 2.
Figure 6:
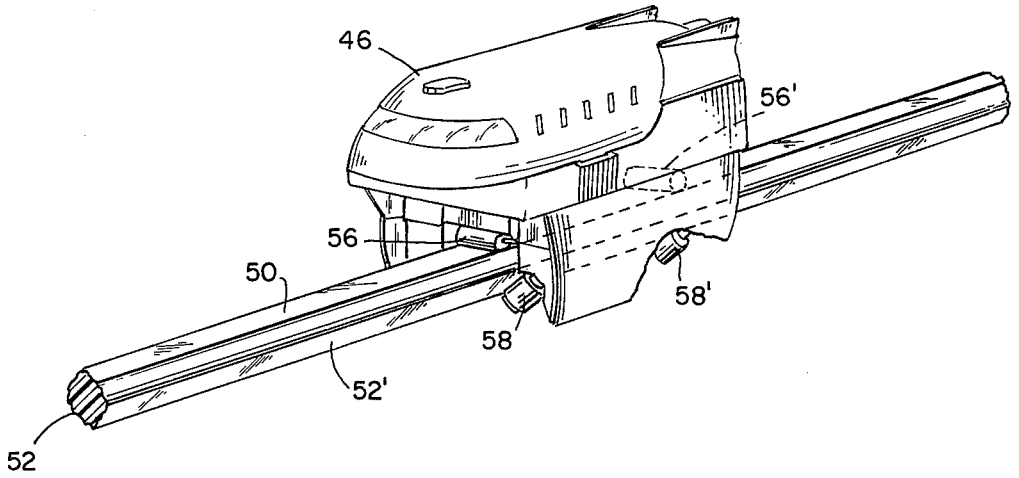
FIG. 6 is a perspective view showing a car running atop a rigid or plastic track section.

The switching system for the toy trains comprise a stationary ring 32 for the terminal portion of the plastic tracks and a second terminal ring 34 supporting the starting ends of the plastic tracks. Adjacent the stationary ring 32 is disposed a rotatable ring 36 which supports one end of track sections 38, 40, 42 and 44 by means of spoke supported rotatable hub 45 and radial struts 47 the other ends of which are connected into the plastic tracks within the stationary ring 34. The hub 45 is connected to stationary hub 49 with the ring 34 by means of shaft 51 which is fixed in the stationary hub of the ring 32. A plurality of support members 55 mounted to turn on the shaft 51 serve to maintain the flexible tracks at a constant radial position relative to the central shaft 51 so that the cars in this section of the system will not interfere with one another in operation. As shown in FIG. 2, the rotatable ring 36 has three rotating positions, A, B and C with a stop 41 for each position which cooperates with a stop 42 atop the stationary ring 32 to assure the proper registry of the plastic track with flexible or rubberized track sections for each of the three positions.

Self propelled car 46 will, it may be seen, with ring 36 in position C, as shown in FIG. 2, starts on flexible track 38 having travelled from plastic top position track 10; it then proceeds to side track 12, then to bottom track 16 via flexible track 40, thence to the other side track 14 via flexible track 44 and back to the top track by means of flexible track 42. Similarly, it may be seen that in position B, the top, side and bottom plastic and flexible tracks will be, respectively, connected together and in position A of the rotatable switching ring the top plastic track is connected to one side plastic track and the bottom plastic track is connected to the other side plastic track.

Figure 7:
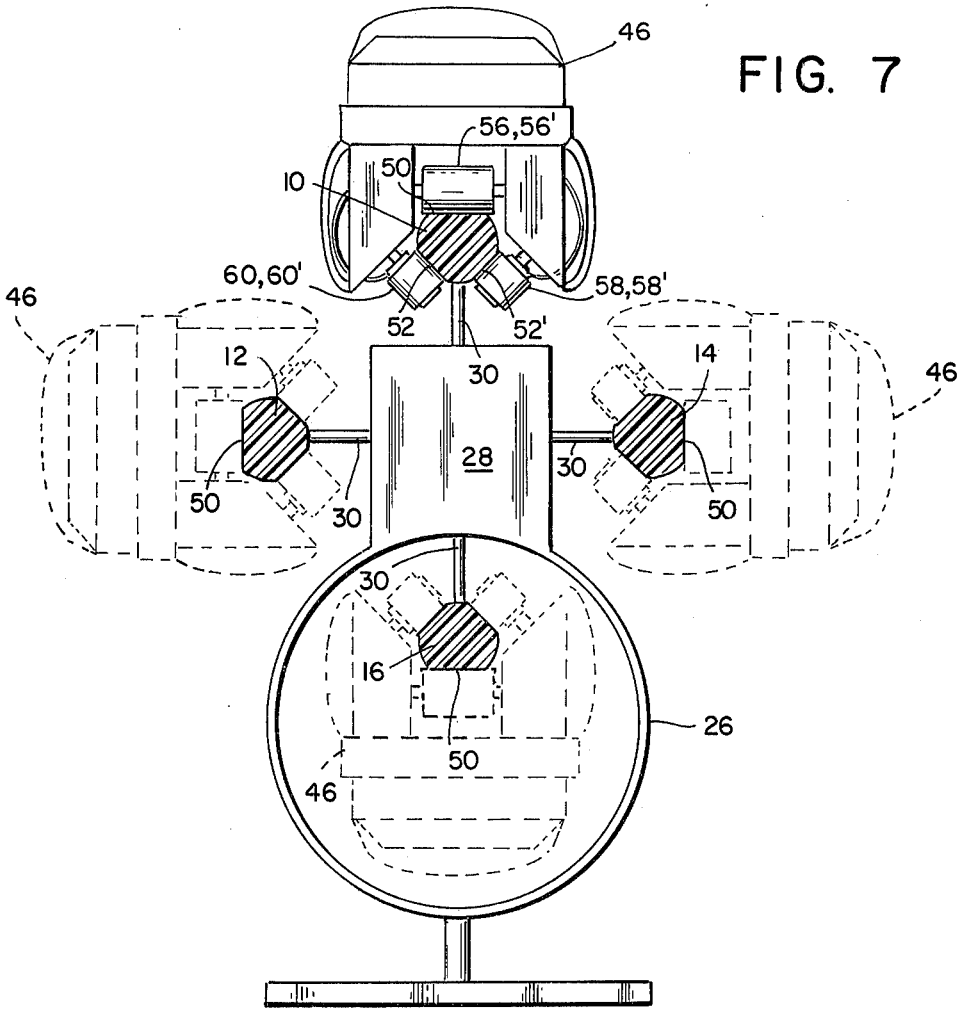
FIG. 7 is an enlarged section taken on the line 7-7 of FIG. 1.

Car 46 is shown in full lines in FIG. 7 on the top track 10 and cars **46*a*, 46*b* and 46*c* are shown in phantom lines on the side and bottom tracks. The plastic and rubberized tracks are identically shaped with one flat top surface 50 and a pair of flat undersurfaces 52 and 52'. The power rollers 56 and 56' of the car engages the surface 50 as a drive mechanism and spring biased rollers 58, 58', 60 and 60'** engage the flat undersurfces to hold the car on the track.

Various modifications of the invention may be effected by persons skilled in the art without departing from the scpe and principle thereof as defined in the appended claims.

What is claimed is:

1. A toy train comprising a plurality of fixed monorail tracks, a plurality of flexible tracks and a switching device for selectively interconnecting said fixed and flexible tracks, said switching device comprising a pair of stationary ring supports for supporting the ends of each of the fixed tracks, one of said stationary ring supports fixedly supporting one end of each of the fixed tracks, a rotatable disc adjacent the other of said stationary rings supporting the other end of said flexible tracks and adapted to selectively connect the latter with said fixed tracks.

* * * * *